United States Patent [19]

Tobin

[11] 4,282,504

[45] Aug. 4, 1981

[54] FAULT LIMITER HAVING A ONE-PIECE ENCLOSURE OF GLASS-REINFORCED RESIN

[75] Inventor: Thomas J. Tobin, Northbrook, Ill.

[73] Assignee: S&C Electric Company, Chicago, Ill.

[21] Appl. No.: 73,667

[22] Filed: Sep. 10, 1979

[51] Int. Cl.[3] ..... H01H 85/20

[52] U.S. Cl. ..... 337/186; 337/248

[58] Field of Search ..... 337/186, 187, 201, 205, 337/246, 248, 252, 414

[56] References Cited

U.S. PATENT DOCUMENTS

| | | | |
|---|---|---|---|
| 3,911,385 | 10/1975 | Blewitt et al. | 337/246 X |
| 4,012,708 | 3/1977 | Goe | 337/248 X |
| 4,035,753 | 7/1977 | Reeder | 337/186 |
| 4,104,604 | 8/1978 | George | 337/248 |

*Primary Examiner*—George Harris

*Attorney, Agent, or Firm*—John D. Kaufmann

[57] ABSTRACT

An improved housing for a high-voltage device which may be subjected to rough handling during installation and to high internal pressure during operation. A flexible, thick outer enclosure is molded about an inner, thin reinforcing layer which has interstices and high tensile strength. The molding locks the enclosure to the layer as the material of the former enters the interstices. The flexibility of the enclosure protects the housing and the device from the effects of rough handling. The flexibility of the enclosure also ensures that it is deformed or stretched sufficiently by high pressures accompanying device operation to ensure that the layer is loaded in tension. Loading the layer in tension ensures that the housing does not fracture or violently rupture.

12 Claims, 3 Drawing Figures

FAULT LIMITER HAVING A ONE-PIECE ENCLOSURE OF GLASS-REINFORCED RESIN

BACKGROUND OF THE INVENTION

1. Field of the Invention

The present invention relates to an improved high voltage device, and more particularly, relates to the construction of a high burst strength one piece enclosure for a high-voltage device. The enclosure is formed from a flexible material reinforced with glass fiber, so that when the device operates, high pressure generated by the device causes the flexible material to give, thereby loading the glass fiber in tension.

2. Description of the Prior Art

The construction of high-voltage devices, such as fuses and fault limiters, including current-limiting fuses, is difficult and often expensive because internal forces which are generated during operation of the devices require a sturdy, well-constructed fault limiter enclosure. Furthermore, such devices are often mounted outdoors, where they are subjected to rough handling, the elements, and other adverse conditions such as pollution. Therefore, special care must be taken to ensure that the enclosures of such fault limiters are rugged and resistant to surface leakage currents.

The prior art discloses the use of rigid, multiple piece, resin enclosures for current limiting fuses wherein the space between a fusible element and the rigid enclosure is filled with a particulate arc-quenching medium. For example, such enclosures are shown in U.S. Pat. No. 4,035,753—Reeder, and pending U.S. patent application Ser. No. 817,985—Biller, filed July 22, 1977 as a continuation of Ser. No. 708,146, filed July 23, 1976 and now abandoned, both assigned to the same assignee as the present invention. The prior art also discloses the use of multiple-piece rigid glass-reinforced resin enclosures as shown in U.S. Pat. Nos. 3,983,525—Healey; 3,986,157—Salzer; and 3,986,158—Salzer. These prior art devices do not utilize one-piece enclosures, and therefore their structural integrity may be compromised, since separate end caps must usually be attached to the enclosure after it is filled with the arc-quenching material. A one-piece housing can be achieved utilizing the invention described in copending application Ser. No. 8,424 filed Feb. 1, 1979 in the name of Guleserian, and assigned to the same assignee as the present invention; however, the Guleserian device is not glass reinforced, and therefore is not as strong as the present invention.

When the present invention is used with a current-limiting fuse, the foregoing disadvantages are overcome because the arc-quenching material may be positioned around the fusible element within a subassembly prior to molding a one-piece glass-reinforced flexible enclosure around the subassembly. Accordingly, the present invention provides a desirable advance in the art by providing a highvoltage current-limiting fuse construction which permits relatively simple, inexpensive manufacturing techniques, while preserving the requisite strength and leakproof characteristics necessary for proper operation.

SUMMARY OF THE INVENTION

An improved enclosure for a high-voltage device in accordance with the present invention comprises a strong, durable, and inexpensive one-piece, glass-reinforced flexible enclosure. The enclosure is formed around a subassembly which can incorporate any of a variety of high-voltage devices which are suited to use in conjunction with an enclosure of the type disclosed. The enclosure is formed by applying glass fiber or glass cloth reinforcing material around the subassembly in any one of several suitable techniques. A flexible one-piece enclosure is then molded around the glass enclosed subassembly in a manner which permits the housing material to fill the interstices of the glass reinforcing material.

In an enclosure made in accordance with the present invention, when high pressures are generated within the enclosure during the operation of the high-voltage device, the flexible enclosure material flexes sufficiently under the stress imposed by the operation of the high-voltage device for the load produced to be transferred to the glass reinforcing material. In this manner, the enclosure will have the burst resistence afforded by the glass reinforcement while remaining resilient in those portions of the enclosure which are not glass reinforced.

In one application of the present invention, the enclosure contains a conventional current-limiting fuse. The fuse includes a current responsive fusible element comprising one or more conductive filaments, a support member supporting the fusible element(s), and terminal assemblies electrically connected to opposite ends of the fusible element(s). Mounted around the fusible element support member is a subassembly housing. The subassembly housing may comprise a tubular member which is enclosed on each end by caps associated with the terminal assemblies. The subassembly housing is filled with arc-quenching material through a filling hole in the subassembly housing, and the arc-quenching material is then compacted in the subassembly by vibration or other suitable means.

Various techniques may be utilized to apply glass fiber or glass cloth reinforcing material around the high-voltage device in accordance with the present invention. The preferred method will depend, in part on constraints imposed by the particular high-voltage device to be housed. One embodiment of the present invention utilizes an open-weave, woven, or mat type reinforcing cloth, which is wrapped around the subassembly housing with the excess material folded over the ends of the subassembly housing.

In a first alternative embodiment, the glass fiber is wound around a form which is somewhat longer then the length of the subassembly housing. The glass fiber is wrapped around the tubular sides and ends of the form in a roving spiral manner and then lightly impregnated with an epoxy resin to bind the glass fiber into a molded housing capable of being handled. After the epoxy resin has cured, the molded housing is cut near its midpoint to create two cup-shaped members. The cup-shaped members are provided with openings or holes at the end to allow insertion of the mounting studs associated with the terminal assemblies. The cup-shaped members are installed over and encapsulate the subassembly housing, with the mounting studs passing through the holes in the cup-shaped members. The cup-shaped members telescope together and overlap near the midsection.

In a second alternative embodiment, glass filament is wrapped around the subassembly housing in a roving spiral manner much the same as that utilized in the manufacture of glass-reinforced pressure vessels.

After the glass reinforcing material has been applied via suitable means, such as those described above, a one-piece flexible enclosure is molded around the glass wrapped subassembly housing. The molded enclosure can be provided with skirts or other surface elongating means which are not reinforced, so that they will retain flexibility and thus be relatively immune to breakage by rough handling. Alternatively the molded enclosure may be fabricated without the use of surface elongating means.

Accordingly, it is a primary object of the present invention to provide an improved housing for a high-voltage device which permits easy, economical fabrication.

Another object of the present invention is to provide a high-voltage device with a one-piece glass-reinforced enclosure which can withstand the forces generated by operation of the device.

A further object of the present invention is to provide a high-voltage device with a one-piece glass-reinforced enclosure which is impervious to leakage.

A still further object of the present invention is to provide a high-voltage device having a glass-reinforced enclosure made of flexible material which effectively transfers the load produced by operation of the device to the glass reinforcing material.

These and other objects, advantages and features of the present invention shall hereinafter appear, and for the purposes of illustration, but not for limitation, exemplary embodiments of the present invention are illustrated in the accompanying drawings.

DETAILED DESCRIPTION OF THE PREFERRED EMBODIMENTS

Figure 1:
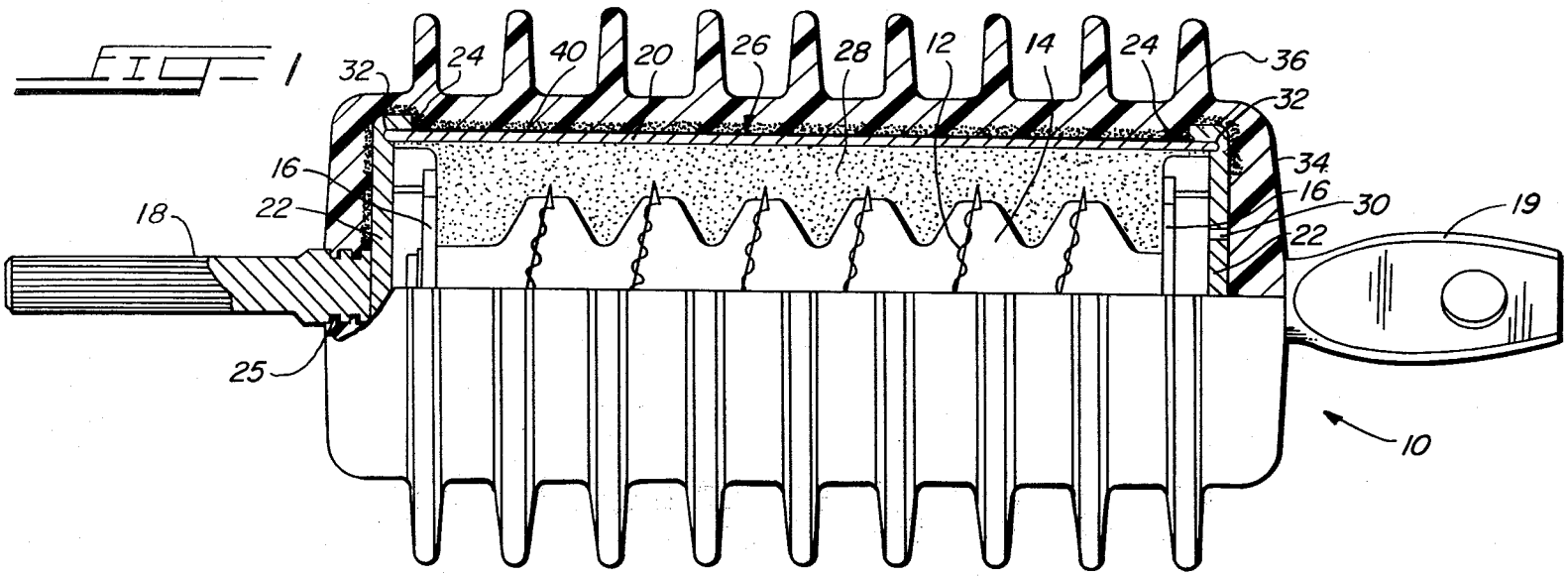
FIG. 1 is a side, partially cross-sectional view of one embodiment of the high-voltage device in accordance with the present invention.

With reference to FIG. 1, the present invention is an improved housing for a high-voltage device. A typical application for the present invention is as a housing for a high-voltage fault limiter, as hereinafter described in detail. However, the present invention is equally applicable to a variety of other high voltage devices, as will be readily apparent to one familiar with the art.

High-voltage fault limiter 10 comprises a current responsive fusible element 12 that is helically wound around a support member 14. Mounted on each end of support member 14 are metallic terminators 16 which are electrically connected to the ends of fusible element 12. Terminators 16 are electrically connected to metal ferrules or end caps 22 by welding or other suitable means. First and second mounting studs 18 and 19 are electrically connected to the metal ferrules or end caps 22 by welding or other suitable means so that an electrical circuit is completed through the fuse. Fusible element 12 is formed of a material that fuses when a current in excess of a predetermined level is passed through it. Support member 14 and terminators 16 may be fabricated in any conventional manner. The fusible element, support member and the terminators illustrated herein are substantially the same as those disclosed in U.S. Pat. No. 4,010,438—Scherer and U.S. Pat. No. 4,057,775—Biller, which are assigned to the same assignee as the present invention.

Mounted around fusible element 12 and support member 14 is a tubular member 20 which is closed at each end by the end caps 22. Tubular member 20 may be formed from any electrically insulating material from which a thin-walled tube may be fabricated. A particularly suitable material for the fabrication of tubular member 20 is rolled paper tubing made from alpha cellulose paper or kraft paper and held together with high temperature glue or impregnated with high temperature resin.

Each of the end caps 22 can be formed with an indentation 32 to center the ends of tubular member 20. In an alternative embodiment, the end caps 22 may be glued to the tubular member 20 using a high temperature adhesive 24 to form a subassembly 26. The subassembly 26 is filled with a suitable arc-quenching material 28, such as quartz or silica sand, through a filling hole 30 in one of the end caps 22, and the arc-quenching material is then compacted by vibration or other suitable means. The subassembly 26 at this stage need only be sufficiently strong to contain the compacted arc-quenching material 28.

The preferred structure for the subassembly 26 in other applications will depend on the nature of the high-voltage device housed therewithin. For example, in applications of the present invention wherein the high-voltage device does not require an environment of arc-quenching material, a sleeve such as tubular member 20 may not be needed.

Various techniques for providing the glass reinforcement may be utilized in accordance with the present invention. As shown in FIG. 1, one embodiment utilizes an open-weave, woven or mat type, glass cloth 40 which is formed completely around the subassembly housing 26, with the excess material folded over the end caps 22 of the subassembly housing 26.

Figure 2:
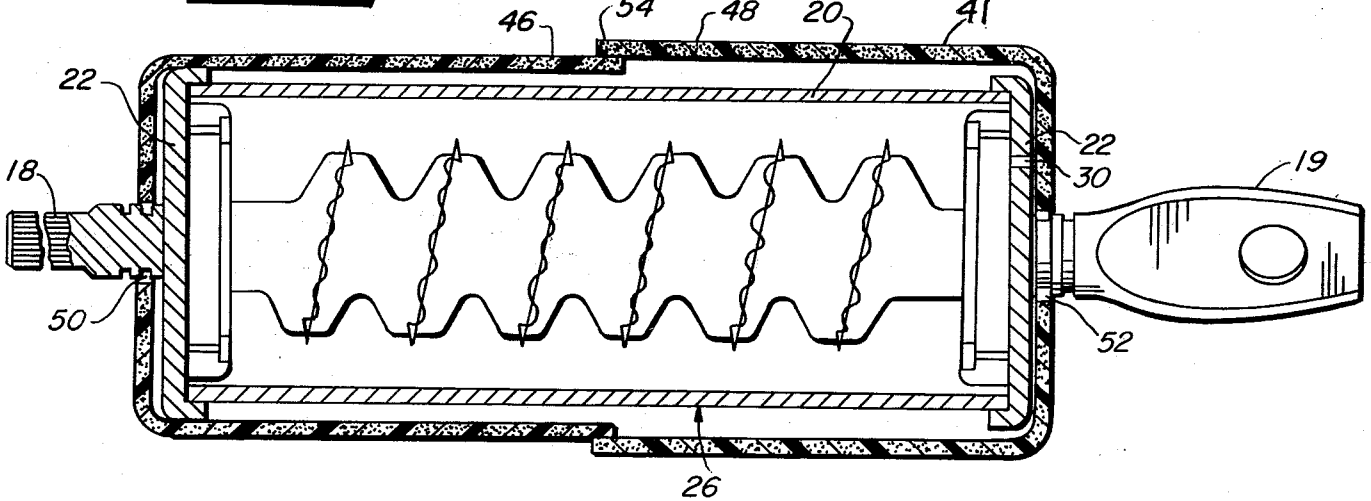
FIG. 2 is a side, partially cross-sectional view of one method of forming glass reinforcement around a subassembly of a high-voltage device in accordance with the present invention.

A first alternative embodiment of the glass reinforcing technique is illustrated in FIG. 2. In this embodiment, glass fiber 41 is wound around the sides and ends of a form which is somewhat longer than the length of the subassembly 26. The fiber is then lightly impregnated with an epoxy resin to bind the fiber into a molded housing capable of being handled. After the epoxy resin has cured, the molded housing is cut near its midpoint to create first and second cup-shaped members 46, 48.

The first and second cup-shaped members 46, 48 are provided with openings or holes 50, 52 for insertion of the first and second mounting studs 18, 19. The first cup-shaped member 46 is installed over and encapsulates one side of subassembly 26 with first mounting stud 18 passing through hole 50 in first cup-shaped member 46. Likewise, second cup-shaped member 48 is installed over and encapsulates the other side of subassembly 26 with second mounting stud 19 passing through hole 52 in second cup-shaped member 48. The first and second cup-shaped member 46, 48 telescope together and overlap near the midsection 54.

Advantageously, the form upon which the molded enclosure is formed may have a slightly enlarged band (not shown) near the midsection so that when the reinforcing body is cut into the first and second cup-shaped members 46, 48 either the first or second cup-shaped member will have a slightly enlarged diameter and thus allow the first and second cup-shaped members 46, 48 to telescope together with minimum effort.

Sufficient overlap of the first and second cup-shaped members 46, 48 at the midsection 54 is provided so that the subsequent steps of molding the flexibilized epoxy resin around the first and second cup-shaped members 46, 48 will produce an enclosure of the requisite longitudinal strength. Several wraps of glass fiber reinforcing strands around the midsection 54 may be used to increase the longitudinal strength of the enclosure.

Figure 3:
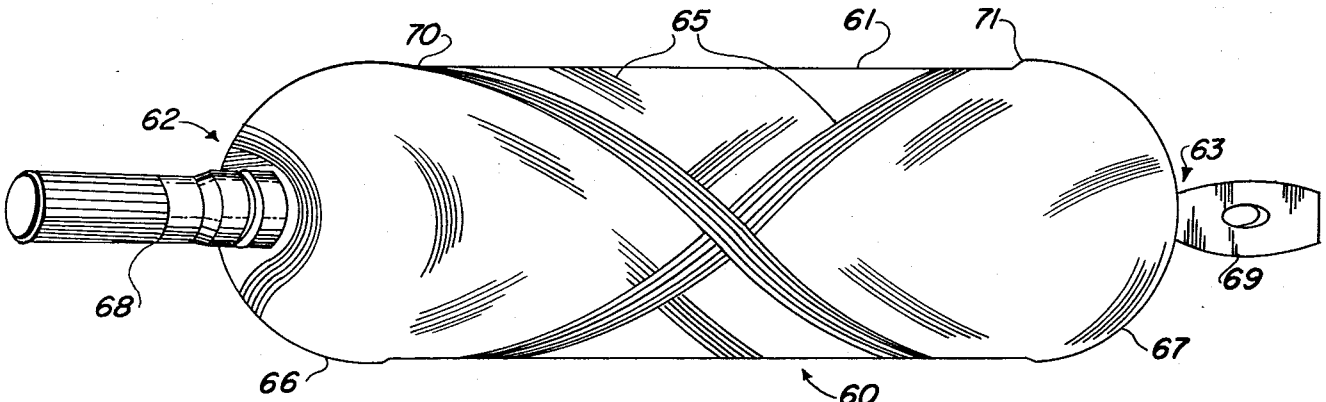
FIG. 3 is a perspective view of an alternative method of forming the glass reinforcement around a subassembly of a high-voltage device in accordance with the present invention.

A second alternative embodiment of the glass-reinforcing technique is illustrated in FIG. 3. In this embodiment, the preferred form of the subassembly 60 takes the form of a cylindrical sleeve 61 closed on both ends by first and second end cap assemblies 62, 63. End cap assembly 62 incorporates hemispherical cap 66, and terminal 68. Similarly, end cap assembly 63 incorporates hemispherical end cap 67 and terminal 69. Terminals 68 and 69 are electrically connected through the operative portion of the high-voltage device contained within sleeve 61. The sleeve 61 can be held in position with respect to end cap assemblies 62 and 63 by lips 70 and 71 respectively formed at the edges of end caps 66 and 67.

In this embodiment of the present invention, the glass-reinforcing material is applied to the subassembly 60 by winding a continuous glass filament 65 around the subassembly 60 in a roving spiral manner as shown in FIG. 3. This method of applying fiberglass reinforcement is particularly effective in improving both the longitudinal and radial burst resistance of the housing. It is also possible to wrap a glass filament around the subassembly in other patterns. For example, a series of longitudinal wraps combined with a series of transverse wraps would provide the requisite axial and radial burst resistance.

The completed housing, (shown only in FIG. 1) including the fiberglass reinforcement 40, 41, or 61 applied by any of the aforementioned techniques, is then molded within a flexible enclosure 34. Materials which can be used for the enclosure 34 include cycloaliphatic resin epoxy resin, polyester resin, phenolics, rubbers, EPDM, and urethanes. If these materials are unfilled, they will have sufficient flexibility to function in accordance with the present invention. If these materials are filled, the addition of flexibilizing material might be necessary in order for the housing 34 to have sufficient flexibility to load the glass fiber 40, 41, or 61 in accordance with the present invention as hereinafter described.

The principal characteristic necessary for suitable housing material is that the material be sufficiently flexible. In an enclosure made in accordance with the present invention, the housing material is molded around the glass-wrapped subassembly so that the enclosure material fills the interstices of the glass-reinforcing material. In this manner, the reinforcing layer and the enclosure become locked together. During operation of the device, the pressure generated will cause the enclosure to flex or deform sufficiently to load the glass fiber reinforcing layer in tension. In this manner, the high burst strength associated with fiberglass reinforced materials can be obtained without depriving the housing exterior of the resilience associated with unreinforced materials. Based upon presently available data, it appears that the housing material must have the ability to stretch at least 2% in order for the glass-reinforcing material to be operative in improving the burst resistance of the housing. Unfilled resins may be used in accordance with the present invention since reinforcing material has already been directly applied to the subassembly. In the alternative, resins filled with antitrack fillers may be used.

Completion of a reinforced enclosure 34 in accordance with the present invention proceeds by placing the glass reinforced subassembly 26 inside a mold cavity. A suitable material such as epoxy resin would be injected into the mold cavity to enclose the subassembly and impregnate the glass-reinforcing material. When the resin has cured, the fault limiter is complete. As shown in FIG. 1, the molded enclosure 34 encloses subassembly housing 26, and partially encloses mounting studs 18 and 19. Mounting studs 18 and 19 may be provided with recesses 25, which help insure watertight integrity between the mounting studs 18 and 19 and the molded enclosure 34.

As also shown in FIG. 1, the molded enclosure 34 can be provided with skirts or other surface elogating means 36 which are not reinforced, so that they will remain flexible and will therefore be relatively immune to breakage caused by rough handling. Alternatively, the molded enclosure 34 may be fabricated without the use of such skirts 36.

In an alternative embodiment of the present invention, the glass-reinforced subassembly can be enclosed by a compression molding technique. In compression molding, the glass-wrapped subassembly would be placed in a heated molded along with a liquid resin. The liquid resin would then be compressed around the subassembly to form the finished housing. In this alternative embodiment, it may be possible to take advantage of the high pressure associated with compression molding to assist in compaction of arc-quenching material within the subassembly housing. This result can be achieved by using a flexible material to serve as the tubular member 20, in accordance with the teachings of co-pending application Ser. No. 8,424 filed Feb. 1, 1979 in the name of Guleserian, and assigned to the same assignee as the present invention.

It should be understood that various changes, alterations, and modifications described herein can be made without departing from the scope and spirit of the present invention as set forth in the following claims.

I claim:

1. An improved housing for a high-voltage device, the device being of the type wherein high pressures may be generated within the housing during operation of the device, wherein the improved housing comprises:

a reinforcing layer surrounding internal elements of the device, the reinforcing layer having high tensile strength and interstital spaces; and a molded, flexible enclosure formed around and impregnating the interstices of the reinforcing layer, high pressures generated by operation of the device deforming the enclosure to load the reinforcing layer in tension.

2. The device of claim 1, which further comprises:

a non-self-supporting tube surrounding the internal elements of the device and around which the reinforcing layer is positioned.

3. The device of claim 1 or 2, wherein the reinforcing layer comprises:

glass fiber filaments or glass fiber cloth wound or positioned so as to be loaded in tension when the enclosure deforms.

4. An improved housing for a high-voltage device which may experience both rough handling during installation or other manipulation thereof and high internal pressures during operation thereof, wherein the improved housing comprises:

a thin inner, reinforcing layer immediately surrounding internal elements of the device, the layer having high tensile strength and interstitial spaces and being flexible traverse of the device, and an outer flexible enclosure molded about the reinforcing layer to a thickness substantially greater than that of the layer so as to impregnate the interstices and lock the enclosure and the layer together, the flexibility of the enclosure obviating damage to the enclosure and to the device from rough handling, the flexible enclosure being sufficiently outwardly deformable by the high internal pressure to load the reinforcing layer tension so as to obviate damage or fracture to the housing caused by operation of the device.

5. An improved housing as set forth in claim 4, wherein:

the flexible and molded enclosure can stretch and elongate at least 2 percent in order to efficiently load the reinforcing layer in tension.

6. An improved housing as claimed in claim 4 wherein the reinforcing layer comprises glass fiber or glass cloth.

7. An improved housing as claimed in claims 6 or 4 wherein the enclosure is fabricated from polyester resin, phenolic, rubber, EPDM, urethane, or epoxy resin.

8. An improved housing as claimed in claims 6 or 4 wherein the enclosure is fabricated from flexibilized cycloaliphatic resin.

9. An improved housing as claimed in claim 4 further comprising:

surface elongating means integrally molded into the exterior surface of the enclosure.

10. An improved housing as claimed in claim 9 wherein the surface elongating means further comprises unreinforced skirts.

11. An improved fault limiter as claimed in claim 6 wherein the reinforcing layer is spiral wound.

12. An improved fault limiter as claimed in claim 6 wherein the reinforcing layer is in part axially wound and in part longitudinally wound.

* * * * *